US005325879A

United States Patent [19]

Burns

[11] Patent Number: 5,325,879

[45] Date of Patent: Jul. 5, 1994

[54] FOLDABLE CRUTCH

[76] Inventor: Donald H. Burns, P.O. Box 1291, Kemah, Tex. 77565

[21] Appl. No.: 39,977

[22] Filed: Mar. 30, 1993

[51] Int. Cl.[5] ..... A61H 3/00
[52] U.S. Cl. ..... 135/67; 135/74
[58] Field of Search ..... 135/67, 68, 74

[56] References Cited

U.S. PATENT DOCUMENTS 4,747,423 5/1988 Hansen et al. ..... 135/68
4,869,280 9/1989 Ewing ..... 135/74 X

*Primary Examiner*—Carl D. Friedman
*Assistant Examiner*—Creighton Smith

[57] ABSTRACT

A conventional tubular aluminum crutch which is modified to be conveniently folded 180° into a compact size and stored when not in use. This crutch is cut in half and by using load-bearing double-male ended couplers which are friction fitted into the lower section struts for slidably engaging the upper section struts. Two cables are secured below the coupler by roll pins in each support tube of the lower section. These cables are then inter-connected to bungee cord within the upper section struts, and the opposite end of the bungee cords are secured by roll pins inside the support tubes of the upper section struts. When used, an individual simply unfolds the crutch, thereby allowing the bungee cord to contract and slidably engage the couplers of the lower section within the open ends of the upper section.

10 Claims, 6 Drawing Sheets

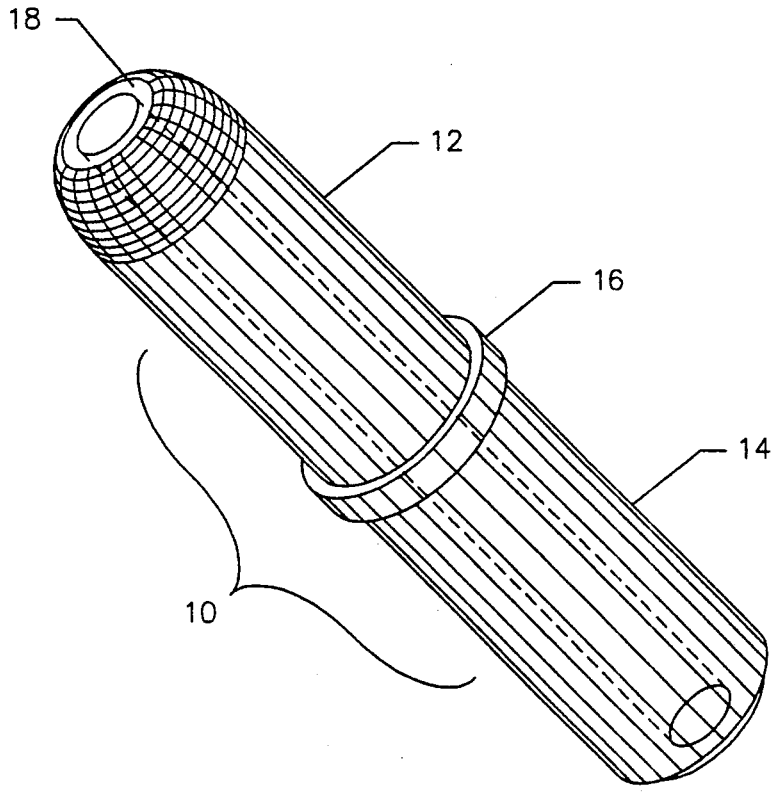
FIG: 1B
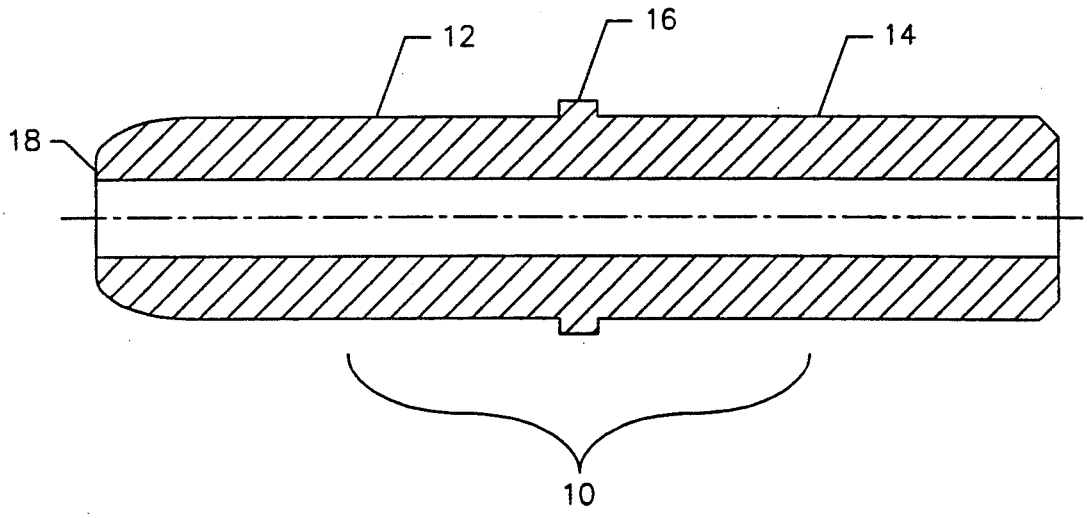

FOLDABLE CRUTCH

Background

1. Field of Invention

This invention relates to a boldable crutch and/or, moreover, the improvement to today's aluminum tubular crutch, so that it may be folded in half when not in use.

2. Description of Prior Art

Crutches, as ordinarily constructed, are clumsy and awkward to handle. Especially, when the user is getting into or out of a vehicle, such as, for example; Planes, Trains, Busses, and Automobiles. With special regards to automobiles, since they keep getting smaller. Crutches are also clumsy/awkward to store while sitting in a chair, wheel-chair, or at a desk or table at a restaurant.

The objective is to devise an easy and cost effective way of manufacturing a folding crutch. While still maintaining strength, durability, safety and ease of conversion from its usable state to its folded state. When folded it should take up a minimum amount of space. When in its linear extended state, it should prevent relative movement of the parts compromising the folding action. The crutch should be, preferably, fabricated from a light-weight tubular material, such as aluminum or magnesium for strength. As well as, having provisions for varying its over-all length for the use by persons of different heights and arm lengths. With regards to arm length, both doctors and therapists agree that the optimum distance is such that the user has to bend his/her arm 30° while using a crutch. With regards to height, both doctors and therapists agree that the optimum distance between the top of the underarm pad and the user's underarm should be at least two inches.

This idea is not new, examples of folding crutches which can be found in the patent, are disclosed by U.S. Patents:

U.S. Pat. No. 2,490,380 granted to Oliver T. Schweppenheiser, (1949)

U.S. Pat. No. 3,492,999 granted to Zane R. Boyd, (1970)

U.S. Pat. No. 3,886,962 granted to Damon Diamontis, (1975)

U.S. Pat. Nos. 4,253,478 (1981) and U.S. Pat. No. 4,437,480 (1984) granted to Emmett O. Husa With the foregoing and other objects in view, as will hereinafter clearly appear, the Prior Art, though having good designs, have not met with some, if not all, of the requirements previously stated.

U.S. Pat. No. 2,490,380 Schweppenheiser (1949), does not provide an easy enough way for the user to be able to convert the crutch from it's usable to it's folded state. This is due to the tension spring (20) which moves the two L-shaped plungers (18 and 19) outward into their locked position would have to be too strong to latch for some people, (i.e. handicapped/elderly/children), to squeeze together. This crutch also does not provide a cost effective design for the manufacturer to have to fabricate. Furthermore, this crutch does not provide a way to adjust the hand support/grip (6) for the user's arm length.

U.S. Pat. No. 3,492,999 Boyd (1970), does not provide an easy enough way for the user to be able to convert the crutch from it's usable state to it's folded state. This is due to the tension spring (42) that holds the lower joint member into the web (40) of the stationary member (28). The tension spring (42) would have to be to strong to provide ample tension for holding member (30) and slots (48 and 50) against pins (36 and 37) to prevent accidental folding while in use. This is cue to slots (48 and 50) not being deep enough. Also, slots (48 and 50) would have to be sized too snugly to pins (36 and 37) to prevent relative movement against the pins (36 and 37). This would make the crutch uneasy to operate for the handicapped, elderly, and children. Furthermore, the folding mechanism would eventually become sloppy from use and possibly fold during use. Again, this crutch would not be cost effective to the manufacturer to fabricate. Finally, this crutch does not provide a way to adjust the hand support/grip (26) for the user's arm length.

U.S. Pat. No. 3,886,962 Diamontis (1975), while this crutch does provide an easy way of folding, the design requires too many machined moving parts, although duplicated, to be cost effective for the manufacturer to fabricate. Furthermore, it requires two people to adjust the crutch for the user's arm length. This is due to having to adjust the underarm assembly (5 thru 9) rather than the hand support grip (4) itself, involving two spring-loaded dentents (8) which have to be depressed simultaneously. This requires another person to adjust the distance between the underarm assembly (5 thru 9) and the hand support/grip. With regards to the leg/foot assembly (1,10 thru 15), this requires two slots (not shown in drawing) in the lower leg (10) to accommodate the through-bolts or rivets (15) as stated. This cannot be structurally sound, because of the weight of the user and the forces involved during use at the point of entry into the upper leg section (11). In other words, causing a weak point.

U.S. Pat. No. 4,253,478 Husa (1981), while this crutch does provide an easy way of folding, it requires the user to feed the hinging section (42 thru 74) into the upper section [(i.e. tubular member 32)]. Therefore, rendering it time consuming and possibly difficult for the handicapped, elderly, and children. As for the locking mechanism [i.e. spring loaded dentent (50 thru 58) ], could accidentally be depressed causing the lower section (12) and the hinging section (42 thru 74) to drop down, allowing the crutch to fold while in use. Furthermore, this crutch does not provide adjustment for either height or arm length, thus, the crutch would have to be made for the individual user. Again, this crutch would not be cost effective to the manufacturer to fabricate, especially if made for the individual.

U.S. Pat. No. 4,437,480 Husa (1984), this patent pertains to an updated/improved version of his previous hinging mechanism. the difference being, Husa has added a ring of collet jaws (90 thru 100), as well as, a ring cam (102). These additions do prevent the accidental dropping of the lower section (12) and the hinging section (42 thru 74), allowing the crutch to fold while in use. The crutch also becomes more difficult to fold or unfold, as well as, even more time consuming. In other words, the crutch wasn't really improved.

In conclusion, these are just some of the reasons why none of the Prior Art has been effectively marketed or available to the past and/or present manufacturer, hospital suppliers, and most of all to the user/consumer.

OBJECTS AND ADVANTAGES

Accordingly, several objects and advantages of the present invention are:

(a) to provide a crutch which is easy to convert from it's usable state to it's folded state and back to it's usable state;

(b) to provide a crutch with a novel locking mechanism that prevents relative movement of the part/s compromising the folding action;

(c) to provide a crutch which is strong and durable, yet, light in weight;

(d) to provide a crutch, when in it's folded state, is minimum in size of space required for storage when not in use;

(e) to provide a crutch which is easy to adjust the hand support/grip to the user's arm length;

(f) to provide a crutch which is easy to adjust the leg/foot assembly to the user's height for the correct distance of the underarm pad;

(g) to provide a crutch which is cost effective to the manufacturer, requiring little or no re-tooling of the factory, and is easy to fabricate;

(h) to provide a crutch which is inexpensive, by today's market, to the hospitals, suppliers, and to the user/consumer.

Further objects and advantages will become apparent from a consideration of the ensuing description and drawings.

BRIEF DESCRIPTION OF THE DRAWINGS

In the drawings, closely related figures have the same numbers but different alphabetic suffixes.

FIG. 1A shows an isometrical view of a load-bearing, double-male ended coupler with hidden lines.

FIG. 1B shows a longitudinal cross section view of a load-bearing, double-male ended coupler

REFERENCE NUMERALS IN DRAWINGS

Figure 2:
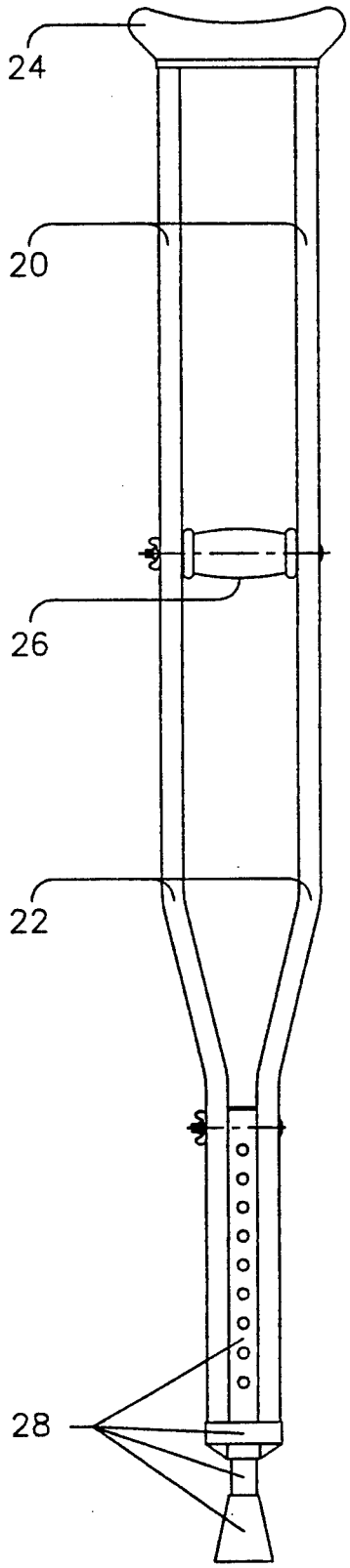
FIG. 2 shows a conventional tubular aluminum crutch manufactured and sold today.

10: load-bearing, double-male ended coupler
12: engaging section
14: fixed section
16: load-bearing annular rib
18: hole
20: upper section strut
22: lower section strut
24: underarm support assembly
26: hand support/grip assembly
28: telescoping leg/foot assembly
30: stainless steel cable
32: bungee cord
34: roll pin
36: cable sleeve clamp
38: bungee cord ring clamp

DESCRIPTION OF FIGURES

FIGS. 1A and 1B show isometrical and longitudinal cross section views of a load-bearing, double-male ended coupler (10). A load-bearing, double-male ended coupler (10) can be made of any number of various materials dependent upon the material to be coupled, which also determines the way of fabricating (i.e. machining, forging, molding, etc. . . . ) the load-bearing, double male ended coupler (10). In this case, the coupling of two sections of tubular aluminum, so the preferred material to use is aluminum, magnesium, carbon fiber, hard plastic, etc. . . . My choice of material was aluminum because of lightness, strength, durability, and overall cost of acquiring and fabricating the load-bearing, double-male ended coupler (10). The process chosen was machining from a solid core aluminum rod, although thick walled aluminum pipe could be used instead. The engaging section (12) of the load-bearing, double-male ended coupler (10) is machined to a minimum of 0.006 of an inch less than the inside diameter of the tubular aluminum being used or to where it slides smoothly, yet not too loosely, in and out of the end of the tubular aluminum being used. Then the end of an engaging section (12) is rounded for ease of engaging-/entering an upper section strut (20), yet leaving a 1/16th of an inch or less flat rim around a hole (18) to prevent chafing of stainless steel cable (30) when bent, shown in FIGS. 5 and 6. A fixed section (14) is machined to no less than 0.004 of an inch than the inside diameter of the tubular aluminum being used, or to where it is held in place by friction fitting into the end of the tubular aluminum, then bevel the end of said fixed section (14) slightly for ease of fitting into the lower section strut (22). A load-bearing annular rib ⅛th inch in width is machined or left (if aluminum rod or pipe is the same size as the tubular aluminum being used) at midpoint between an engaging section (12) and a fixed section (14) matching the outside diameter of the upper section strut (20). A hole (18) is drilled lengthwise (if aluminum pipe is not used) through a load-bearing, double-male ended coupler (10) no less than ¼ of an inch in diameter.

FIG. 2 shows one of many conventional tubular aluminum crutches already being manufactured and sold to the public today. This particular model has an underarm support assembly (24), adjustable hand support/grip assembly (26), a telescoping leg/foot assembly (28), an upper section struts (20), and a lower section struts (22) already built into the crutch.

Figure 3:
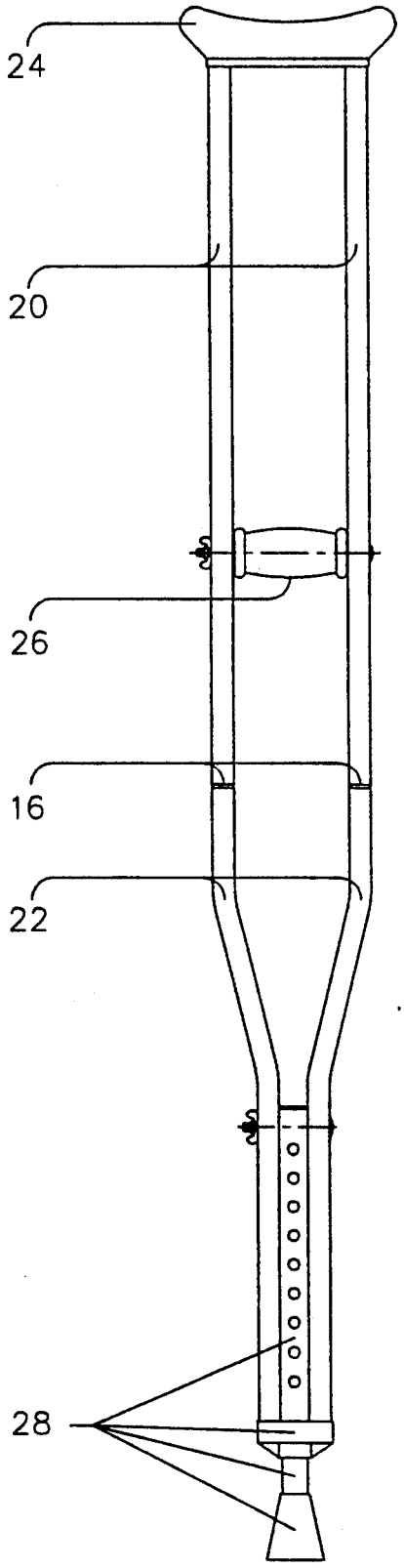
FIG. 3 shows a conventional tubular aluminum crutch improved/modified.

FIG. 3 shows one of many conventional tubular aluminum crutches as shown in FIG. 2 only improved and modified showing all the same parts and sections as in FIG. 2 but now showing a load-bearing annular rib (16) in place between an upper section struts (20) and a lower section struts (22).

Figure 4:
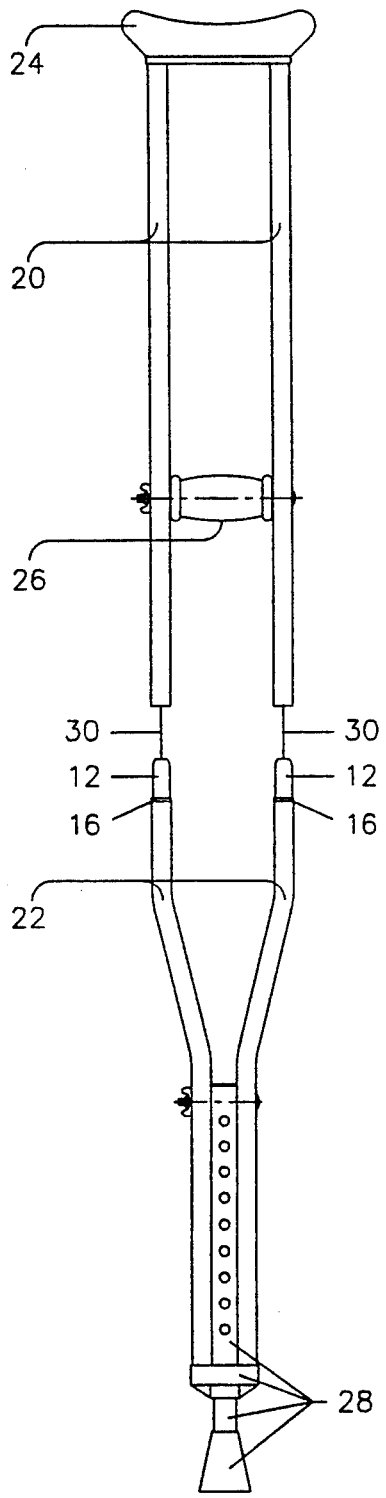
FIG. 4 shows an improved/modified conventional tubular aluminum crutch separated for folding.
Figure 5:
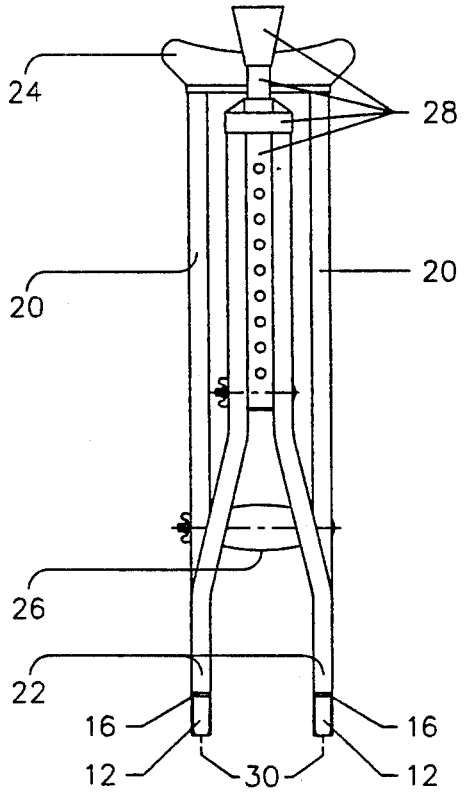
FIG. 5 shows an improved/modified conventional tubular aluminum crutch in it's folded state, front view.
Figure 6:
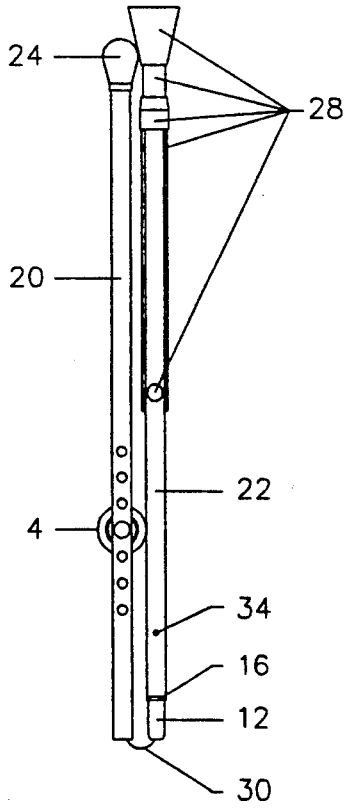
FIG. 6 shows an improved/modified conventional tubular aluminum crutch in it's folded state, side view.

FIGS. 4, 5, and 6 show an improved and modified conventional tubular aluminum crutch in a frontal separated view, frontal folded view, and side folded view shown respectively. All views showing upper section struts (20), lower section struts (20), underarm support assembly (24), hand support/grip assembly (26) and a telescoping leg/foot assembly (28). A load-bearing double-male ended coupler (10) is in place showing an engaging section (12), load-bearing annular rib (16), and stainless steel cable (30).

Figure 7:
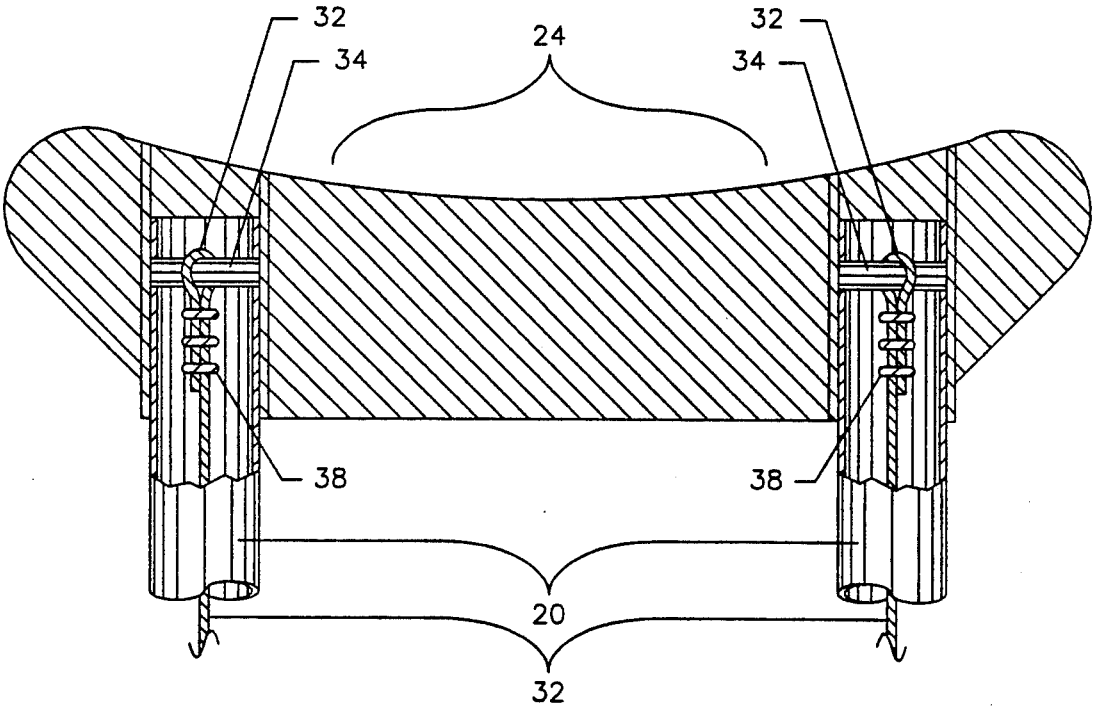
FIG. 7 shoes a front cross sectional view of inside an underarm assembly and the securing of a bungee cord to an upper section strut and duplicated on the other-side.

FIG. 7 shows a front cross sectional view of an underarm support assembly (24) showing both upper section struts (20) fitted inside. Inside both upper section struts (20) are bungee cord (32) looped around roll pin (34) and secured to itself by bungee cord ring clamps (38), thus, securing the distal end of bungee cord (32).

Figure 8:
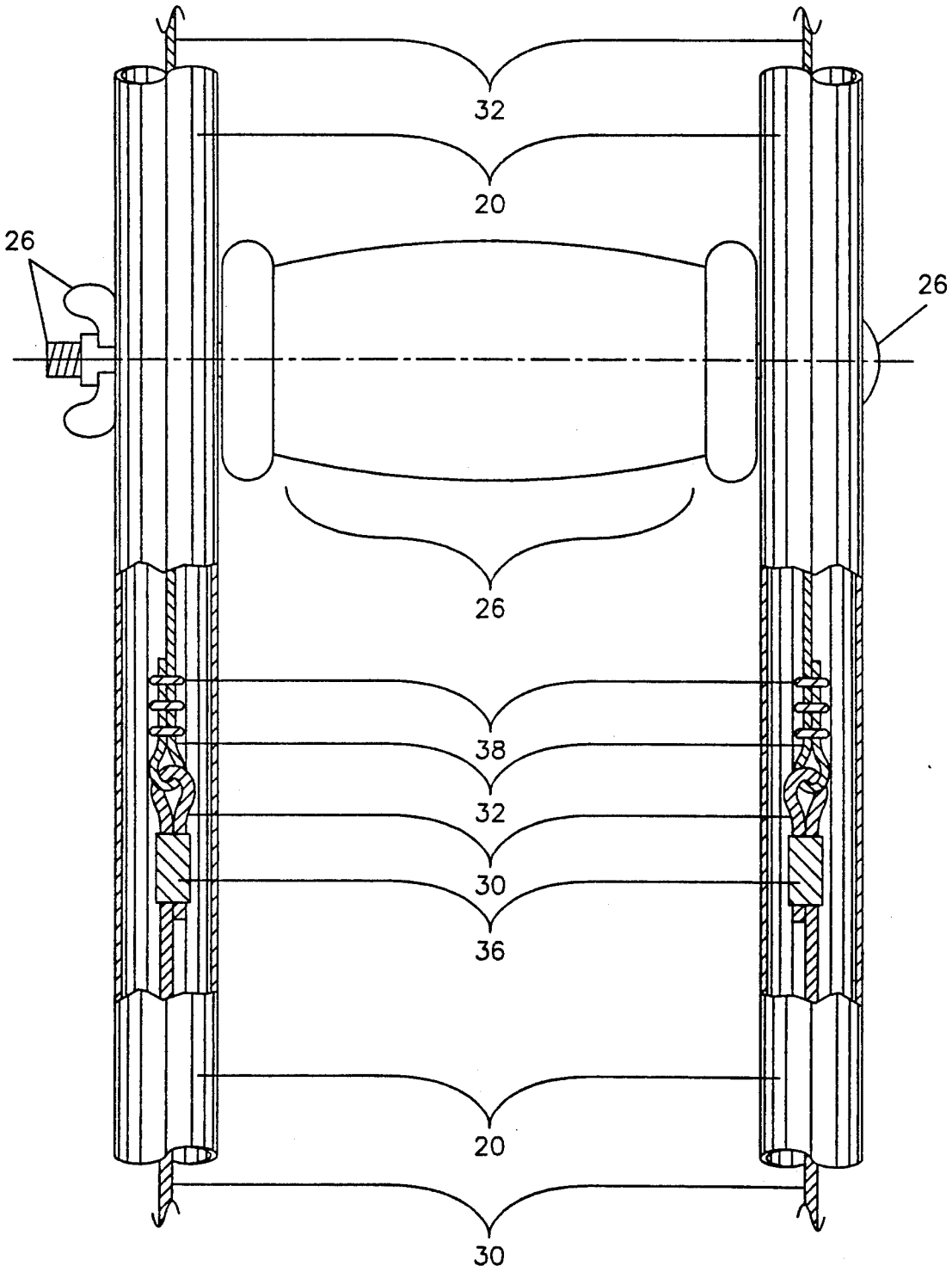
FIG. 8 shows a front cross sectional view of inside a tubular aluminum strut and the securing/looping together of a bungee cord to a stainless steel cable and duplicated on the other-side.

FIG. 8 shows a front sectional view of the upper section struts (20), including a hand support/grip assembly (26). Below the lowest setting of hand support/grip assembly (26) is an internal cross section view of each upper support struts (20) showing a bungee cord (32) being inter-connected with stainless steel cable (30) by making an eye in bungee cord (32) using bungee cord ring clamps (38) and making an eye in stainless steel cable (30) using a cable sleeve clamp (36) and linking the two together.

Figure 9:
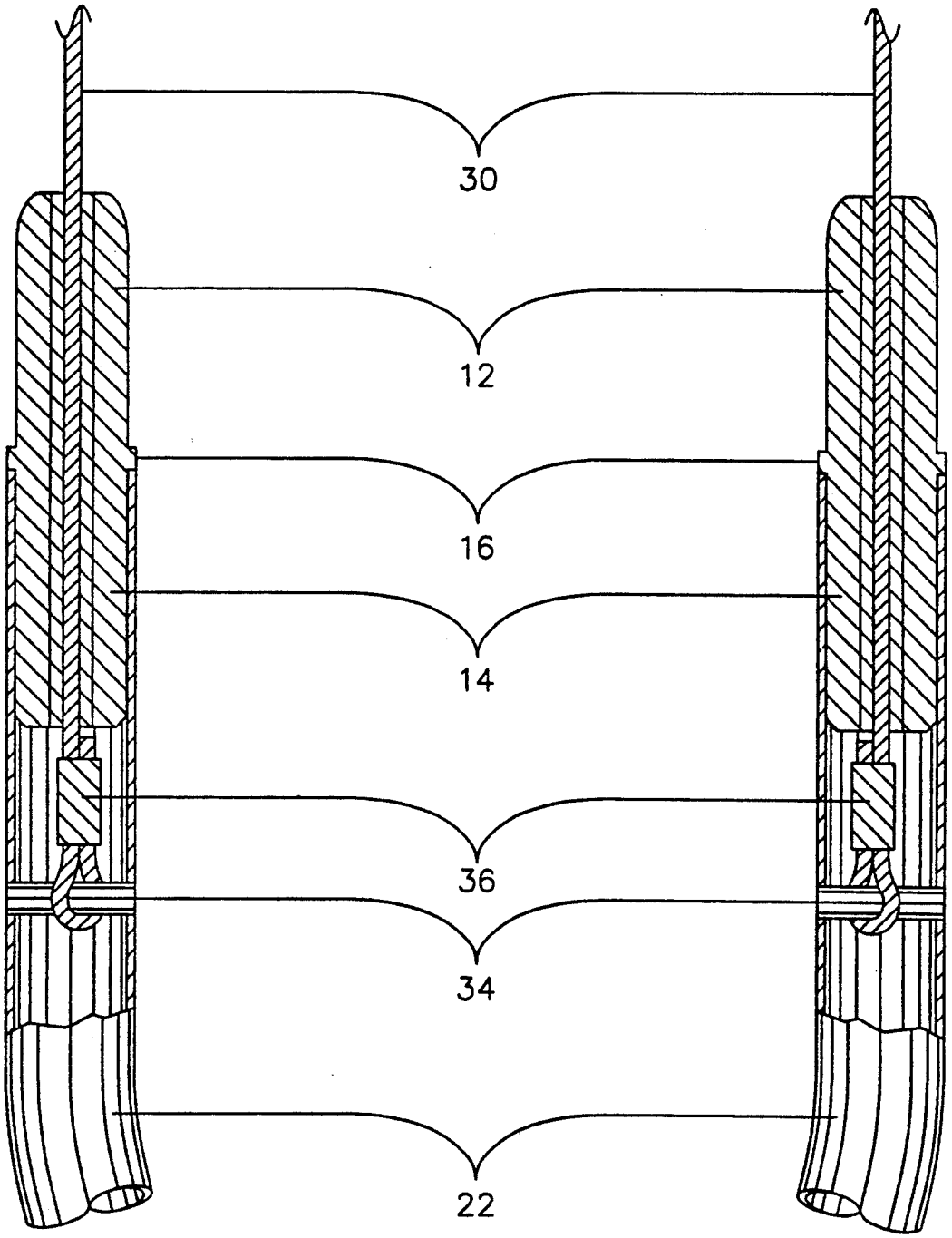
FIG. 9 shows a front cross sectional view of a tubular aluminum strut with a load-bearing, double-male ended coupler friction fitted in, and the securing of a stainless steel cable below it to the inside of same tubular aluminum strut, and duplicated on the other-side.

FIG. 9 shows a cross sectional view of lower section struts (22). This also shows the friction fitting of load-bearing double-male ended coupler (10) with stainless steel cable (30) running through it and securing to roll pin (34) via eye made using cable sleeve clamp (36), thus securing distal end of stainless steel cable (30) to lower section struts (22). Stainless steel was picked due to it's resistance to chafing and eventually becoming weak and breaking, (my choice was 600 lb./test, shark resistant fishing leader because of strength, durability, and flexibility). Stainless steel cable (30) is 6 inches in length, eye to eye, but may vary dependent upon crutch size.

From the description above, a number of advantages of the improved crutch becomes evident:

(a) The improved crutch is able to easily convert to and from it's linear extended state to it's folded state and back again, which the handicapped, elderly, and children can easily perform without outside assistance.

(b) The improved crutch has a novel locking mechanism that prevents relative movement of the part/s compromising the folding action which handicapped, elderly, and children are easily capable of using, which works with no moving part/s (i.e. user friendly).

(c) The improved crutch is light in weight, strong, durable and quick to fold/unfold (i.e. user won't get drenched if caught in rain).

(d) The improved crutch when folded uses very little space for storage when not in use. Can be stored under any chair anywhere, (restaurants, buses, trains, and planes, etc. . . . ). Is easily stored in any size automobile, (even MGB's, Corvettes, or Porsches, etc. . . . ).

(e) The improved crutch has an adjustable hand support/grip assembly (26) for adjusting to the user's arm length.

(f) The improved crutch has an easily adjustable telescoping leg/foot assembly (28) for adjusting the correct distance of underarm support assembly (24) to the underarm of the user to his/her height.

(g) The improved crutch is cost effective for the manufacturer, requiring little or no re-tooling of it's factory and is easy to convert the manufacturer's own style of crutches into the improved crutch.

(h) The improved crutch is cost effective to the manufacturer so it should be inexpensive to the hospitals and their suppliers, retail and rental outlets, and best of all to the user/consumer.

The operating features of a load-bearing, double-male ended coupler (10) shown in FIGS. 1A and 1B are as follows: an engaging section (12) is rounded so as to slide smoothly into and out of upper section strut (20) when fixed section (14) is friction fitted into lower section strut (22), thus, an upper section strut (20) and lower section strut (22) can be coupled together with nothing sticking out around the upper and lower section struts (20 and 22) to catch anything on. A load-bearing annular rib (16) is placed between upper and lower section struts (20 and 22) for the purpose of support/-transfering the weight of the user on through the rest of the crutch to the ground without the overlapping/overriding or sticking together of each other. A hole (18) is for the stainless steel cable (30) to be able to run easily through it from end to end.

FIGS. 3, 4, 5 and 6 show the operating of the improved crutch from an extended linear state or usable state, FIG. 3, to the separation or pulled apart stage of upper section struts (20) from lower section struts (22) by merely pulling the two apart, FIG. 4, then by folding the two sections in half a improved crutch collapses to it's folded or storage state, shown in FIGS. 5 and 6, yet still staying connected together by bungee cord (32) and stainless steel cable (30).

FIG. 7 shows an underarm support assembly (24) inside which bungee cord (32) is secured inside upper section strut (20) by a friction fitted roll pin (34), this securing is done at the location to minimize the chance of roll pin (34) accidentally coming out. The other end of bungee cord (32) is then joined with stainless steel cable (30), as shown in FIG. 8, and then stainless steel cable (30) is secured inside lower section strut (22) by a friction fitted roll pin (34) you now have a spring-loaded upper and lower section struts (20 and 22). When this process is duplicated on the other side of the crutch to upper and lower section struts (20 and 22) the end result is a improved crutch (i.e. improved/modified conventional tubular aluminum crutch) which can be pulled apart and folded in half for storage, which is spring-loaded, via bungee cord (32), so that when unfolded it automatically pulls itself into a rigid linear extended state for use.

Accordingly, the reader will see that the present invention is an improved/modified conventional tubular aluminum crutch manufactured today. By doing this most requirements are met to start with although this may vary due to different manufacturers. In addition to the requirements met (light in weight, strength, durability, and adjustability to fit the user), the present invention is easy to use, (fold/unfold), easy to manufacture, cost effective to the manufacturer, and inexpensive to the suppliers and/or user. Handi-Crutch is very easy to operate for the handicapped, elderly and children simply pull the upper and lower sections apart and fold in half, there is no pins to pull, springs and/or hinges, detents, or twisting part(s) to fool with. As for unfolding for use, he/she simply holds on to the underarm pad and let gravity work for them by letting the leg/foot assembly drop, the bungee cord's tension will pull the two sections together, linearly extending them and becoming rigid, thusly, the user is ready to go. The present invention when not stored or in use as a crutch can be unfolded partially to about a 45° angle and stood on it's foot and underarm pad forming an upside-down 'V' standing on the ground, thus, a three point stance is made. If the user carefully places his/her foot or ankle in-between the fork formed by the lower section struts and resting it on the hand support/grip assembly the user has a convenient foot rest/stool. However, the user must use extreme caution when doing this, because of the ease of the foot rest/stool position in falling to one side or the other.

While my above description contains many specificities, these should not be construed as limitations on the scope of the invention, but rather as an exemplification of one preferred embodiment thereof. Many other variations are possible. For example a person(s) or manufacturer might add detents, locking pins and/or rings, they may not use bungee cord or just some other type of elastic arrangement or not use any at all just some type of cable and/or change the shape of the load-bearing, double-male ended coupler in some way, or do all of the aforementioned things, etc.

Thus, accordingly the scope of the invention should be determined not by the embodiment(s) illustrated, but by the appended claims and their legal equivalents.

I claim:

1. An improved foldable crutch having a first section demountably connected to a second section, the improvement comprising:

an elastic cord having an end affixed to one of the first and second sections interior of such section; and a non-elastic flexible cable having one end connected to said elastic cord and extending interior of said first and second sections, said cable extending continuously from said one of said first and second sections into the other of said first and second sections, said cable having an opposite end affixed within the other section.

2. The improvement of claim 1, said end of said elastic cord affixed to a roll pin within said one of said first and second sections, said elastic cord extending outwardly from said roll pin.

3. The improvement of claim 2, said elastic cord having a loop formed in an end opposite said roll pin, said one end of said cable connected to said loop.

4. The improvement of claim 3, said cable having an eye formed in said one end, said eye engaging said loop of said elastic cord.

5. The improvement of claim 4, said loop and said eye positioned within an interior of said one of said sections.

6. The improvement of claim 1, further comprising:

an engaging section of tubular configuration fitted in an end of one of said first and second sections and slidably receiving an end of the other of said first and second sections, said cable extending through an interior of said engaging section.

7. The improvement of claim 1, said cable having said opposite end affixed to a roll pin affixed within an interior of said other section.

8. The improvement of claim 7, said opposite end of said cable having a loop formed therein, said roll pin received by said loop, said cable extending outwardly from said roll pin.

9. The improvement of claim 1, said elastic cord being a bungee cord, said cable being a stainless steel cable.

10. The improvement of claim 1, said cable extending along an area of connection of said first section to said second section.

* * * * *

UNITED STATES PATENT AND TRADEMARK OFFICE

CERTIFICATE OF CORRECTION

PATENT NO. : 5,325,879

DATED : July 5, 1994

INVENTOR(S) : Donald H. Burns

It is certified that error appears in the above-indentified patent and that said Letters Patent is hereby corrected as shown below:

Column 1, line 6, change "boldable" to read --foldable--.

Signed and Sealed this

Eighteenth Day of October, 1994

Bruce Lehman

*Attest:*

BRUCE LEHMAN

*Attesting Officer*

*Commissioner of Patents and Trademarks*